US006116041A

United States Patent [19]

Cassell

[11] Patent Number: 6,116,041

[45] Date of Patent: Sep. 12, 2000

[54] BEVERAGE CHILLER

[75] Inventor: Allan John Cassell, West Heidelberg, Australia

[73] Assignee: Southern Refrigeration Group Pty. Ltd., Melbourne, Australia

[21] Appl. No.: 09/150,828

[22] Filed: Sep. 10, 1998

[51] Int. Cl.[7] ..... F25D 23/12

[52] U.S. Cl. ..... 62/338; 62/199; 165/144

[58] Field of Search ..... 62/338, 339, 515, 62/199, 200; 165/143, 144, 160

[56] References Cited

U.S. PATENT DOCUMENTS

| | | | |
|---|---|---|---|
| 2,228,834 | 1/1941 | Kramer, Jr. | 62/200 |
| 2,316,376 | 4/1943 | Weiss | 62/199 |
| 2,964,926 | 12/1960 | Ware | 62/515 |
| 3,020,728 | 2/1962 | Lande | 62/199 |
| 3,280,904 | 10/1966 | Hings | 165/143 |
| 4,570,702 | 2/1986 | Stafford et al. | 165/160 |

FOREIGN PATENT DOCUMENTS

| | | |
|---|---|---|
| 7904781 | 6/1983 | Australia . |
| 3227206 | 1/1984 | Germany . |
| 1242968 | 8/1971 | United Kingdom . |
| WO9521365 | 8/1995 | WIPO . |

*Primary Examiner*—William E. Tapolcai
*Attorney, Agent, or Firm*—Moffa & Sun, P.A.

[57] ABSTRACT

The present invention provides an improved beverage chiller comprising at least two interconnected canisters each canister defining a chamber for refrigerant. The chamber includes a plurality of pipes extending along the length of the chamber for the flow of beverage thereghrough. Each canister includes flow control means to ensure flow of beverage up and down the refrigerant chamber in a plurality of cooling passes. The refrigerant chambers are pressure balanced and arranged to be coupled to a source of refrigeration via a thermostatic expansion valve.

14 Claims, 2 Drawing Sheets

BEVERAGE CHILLER

FIELD OF THE INVENTION

The present invention relates to beverage chillers.

There is a need to chill carbonated and non-carbonated bulk beverages such as, for example, beer and wine. In some situations there is a requirement to produce a constant flow of chilled beverage at a temperature of as low as 2 to 3° C. at a flow rate of up to 50 litres per hour. These parameters place demanding requiremrents on suitable equipment.

One known technique for chilling bulk beverages is to pass the beverage through a continually refrigerated ice bag. However this technique suffers from a limitation on the flow rate which can be achieved whilst maintaining the desired chilled temperatures.

Another known beverage chiller is a product known as TEMPRITE. In this product, the beverage passes through a single spiral coil that is immersed in refrigerant. In order to ensure a constant level of refrigerant this product uses a float in conjunction with a cartridge valve. However a shortcoming with this equipment is that it requires frequent ongoing maintenance with the ensuing cost associated with servicing. For example, the float and cartridge valve control utilised in the product is prone to sticking in an open position or leaking after a period of use. If such conditions are left unchecked, flooding of the refrigerant into the compressor can occur and can lead to compressor failure.

Such problems have brought about the present invention.

SUMMARY OF THE INVENTION

According to the present invention, there is provided a beverage chiller comprising at least two interconnected canisters, each canister defining a chamber for refrigerant, said chamber including a plurality of pipes extending along the length of the chamber for the flow of beverage therethrough, each canister including flow control means to ensure flow of beverage up and down the refrigerant chamber in a plurality of cooling passes, said refrigerant chambers being pressure balanced and arranged to be coupled to a source of refrigeration via a thermostatic expansion valve.

Preferably the canisters are interconnected such that the beverage completes its cooling passes in one canister before completing further cooling passes in the second canister.

Preferably a flow control means is provided at each end of each canister to ensure flow of beverage up and down the refrigerant chamber in a plurality of cooling passes. It is further preferable that the flow control means comprises a partitioned plate provided at each end of each canister.

It is further preferable that each of the chambers is coupled to a source of refrigerant and an evaporator pressure regulator valve.

Preferably the refrigerant chambers of the canisters are interconnected at three points along the length of the canister where a first connection is a suction connection that is in turn coupled to a compressor of a refrigeration circuit, a second connection is a balancing pipe that ensures pressure balance between said canisters, and a third connection is a thermal expansion valve feed connection.

It is also preferable that the pipes of each chamber are arranged in an array which is parallel to the principal axis of the canister.

BRIEF DESCRIPTION OF THE DRAWINGS

By way of example, a preferred embodiment of the present invention will now be described with reference to the accompanying drawings in which.

DISCUSSION OF THE PREFERRED EMBODIMENT

Figure 1:
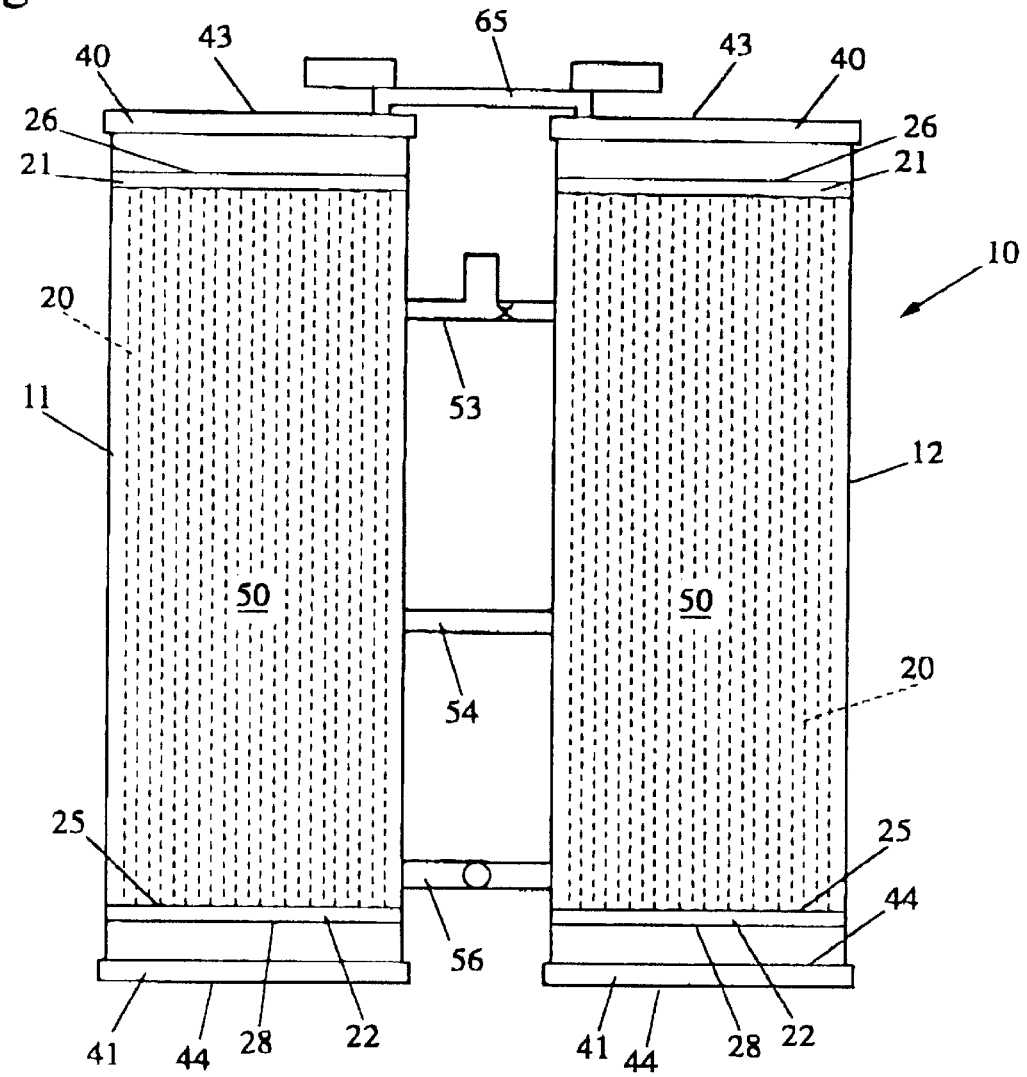
FIG. 1 is a side elevation view of a preferred embodiment of a beverage chiller according to the present invention.

The beverage chiller 10 illustrated in the accompanying drawings comprises two stainless steel canisters 11 and 12, of approximately 100 millimetres (≈4 inches) in diameter and 350 millimetres (≈13.5 inches) in length. Each canister 11, 12 preferably houses thirty two stainless steel pipes 20 of relatively small bore that are arranged in an array which is parallel to the principal axis of the canister. The pipes 20 are of 4.8 millimetres (3/16 inch) nominal bore and approximately 300 millimetres (≈12 inches) in length and are supported at either end by directional flow plates 21, 22. The directional flow plates 21, 22 are provided with thirty two small holes 23 and the ends of the pipes 20 are welded into these holes. The upper flow plate 21 has its upper surface 26 segmented into five compartments 30, 31, 32, 33, 34 by upwardly projecting and radially extending baffles 27. The lower plate 22 has its lower surface 28 segmented into four compartments 35, 36, 37, 38 by radially extending baffles 29. Each plate 21, 22 is welded to the interior of the canister 11 or 12 at a position approximately 10 millimetres (≈0.5 inch) below the top and bottom of the canister. The canisters are closed and sealed at both ends 40, 41. Five segments 43 are individually welded to the upwardly projecting baffles 27 to seal the upper end 40 of each of the canisters, whilst four segments 44 are individually welded to the downwardly projecting baffles 29 to seal the lower end 41 of each of the canisters.

The cavities 50 that house the pipes 20 between the directional flow plates 21, 22 of the canisters contain refrigerant and are coupled to a standard refrigeration circuit which includes a source of refrigerant and an evaporator pressure regulator valve. It is understood that the design and operation of the refrigeration circuit would be well known to those skilled in this art and therefore it is not described in detail in this specification.

As shown in FIG. 1, the refrigerant cavities 50 of canisters 11, 12 are interconnected at three points 53, 54, 56 along the length of the canisters. The upper connection 53 is a suction connection that is in turn coupled to the compressor of the refrigeration circuit. The central connection 54 is a balancing pipe that ensures pressure and refrigerant level balance between the canisters 11, 12. The lower connection 56 is a T.X. (Thermostatic Expansion) valve feed connection. The T.X. valve temperature control is located at a point approximately 300 millimetres (≈12 inches) along on the upper connection 53 on the suction pipe to the compressor.

Figure 2:
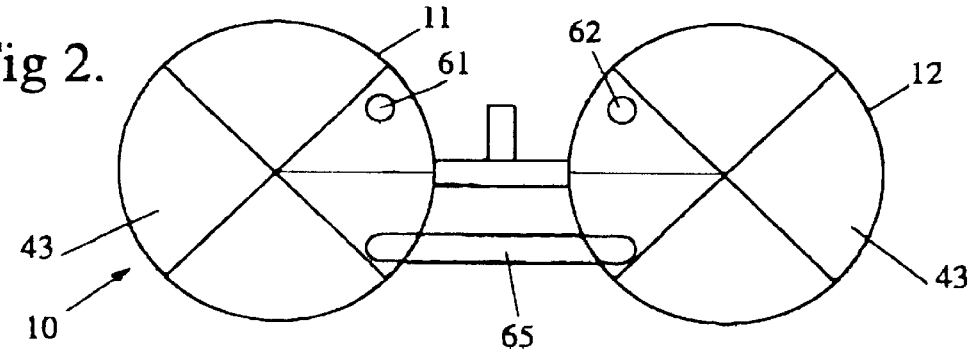
FIG. 2 is a plan view of the beverage chiller depicted in FIG. 1.
Figure 3:
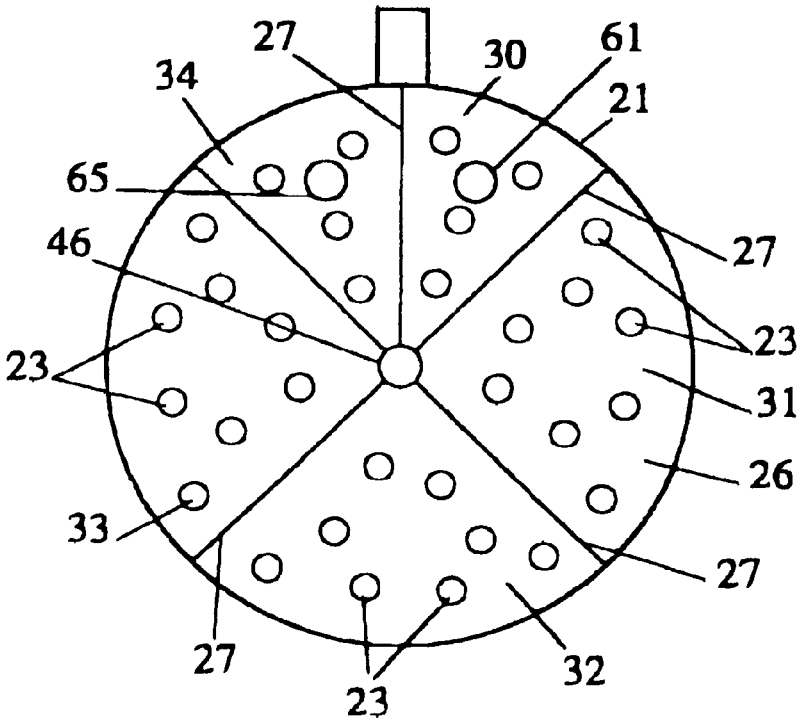
FIGS. 3 and 4 are plan views of upper and lower directional flow plates utilised in the preferred embodiment of the beverage chiller.
Figure 4:
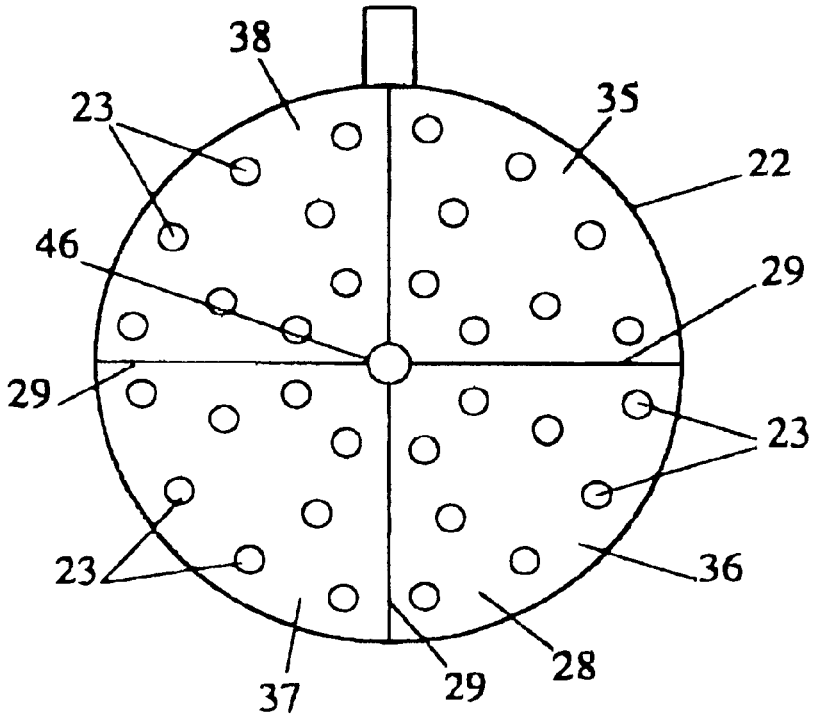

The end segments 43, 44 are welded against the adjacent outer edges of the baffles 27, 29 to define segmented compartments 30 to 34 and 35 to 38 at each end of the canisters 11, 12. As shown in FIG. 2, one compartment 30 at the top of each canister has an opening which constitutes the beverage inlet 61 and beverage outlet 62. The compartments 34 are interconnected by a bridge 65.

In use the beverage to be chilled enters the first canister 11 via the inlet 61 into compartment 30. The beverage then flows down the four small bore pipes 20 contained in segment 30 to reach the compartment 35 defined by the lower directional flow plate 22. The beverage then flows up the four pipes to reach the upper compartment 31. It then flows down four pipes to reach compartment 36, back up to compartment 32, down to compartment 37, up to compartment 33, down to compartment 38 until it reaches upper compartment 34 from where it proceeds to the second canister 12 via bridge 65 where the circulation operation is repeated.

chiller can be incorporated into a refrigeration circuit or could be simply coupled to an existing refrigeration system.

Overleaf are results of a test programme in which water was supplied into the beverage chiller at temperature of 17.5° C. and a 10 oz glass was drawn off every 20 seconds for one hour. The temperature of each glass of water drawn off was noted as ranging from 0.7° C. to 2.9° C. at a delivery of 51.2 litres per hour (≈11.25 gallons per hour).

| No. | °C. Temp. | No. | °C. Temp. | No. | °C. Temp. | No. | °C. Temp. | No. | °C. Temp. | No. | °C. Temp. |
|---|---|---|---|---|---|---|---|---|---|---|---|
| 1. | 0.8 | 31. | 2.3 | 61. | 1.8 | 91. | 1.6 | 121. | 1.7 | 151. | 1.7 |
| 2. | 0.7 | 32. | 2.3 | 62. | 1.8 | 92. | 1.7 | 122. | 1.6 | 152. | 1.7 |
| 3. | 0.8 | 33. | 2.3 | 63. | 1.8 | 93. | 1.6 | 123. | 1.6 | 153. | 1.6 |
| 4. | 1.1 | 34. | 2.2 | 64. | 1.8 | 94. | 1.6 | 124. | 1.6 | 154. | 1.7 |
| 5. | 1.6 | 35. | 2.2 | 65. | 1.8 | 95. | 1.8 | 125. | 1.7 | 155. | 1.7 |
| 6. | 1.8 | | 2.3 | | 1.8 | | 1.6 | | 1.6 | | 1.7 |
| 7. | 2.0 | | 2.3 | | 1.8 | | 1.6 | | 1.7 | | 1.7 |
| 8. | 2.1 | | 2.3 | | 1.8 | | 1.6 | | 1.7 | | 1.7 |
| 9. | 2.1 | | 2.3 | | 1.8 | | 1.6 | | 1.7 | | 1.7 |
| 10. | 2.1 | 40. | 2.3 | 70. | 1.8 | 100. | 1.6 | 130. | 1.7 | 160. | 1.7 |
| 11. | 2.1 | | 2.3 | | 1.9 | | 1.6 | | 1.6 | | 1.7 |
| 12. | 2.2 | | 2.2 | | 1.9 | | 1.6 | | 1.7 | | 1.7 |
| 13. | 2.3 | | 2.2 | | 1.9 | | 1.6 | | 1.7 | | 1.7 |
| 14. | 2.3 | | 2.1 | | 1.9 | | 1.6 | | 1.6 | | 1.7 |
| 15. | 2.3 | | 2.0 | | 1.9 | | 1.5 | | 1.8 | | 1.7 |
| 16. | 2.4 | | 1.8 | | 1.9 | | 1.6 | | 1.7 | | 1.6 |
| 17. | 2.4 | | 1.8 | | 1.9 | | 1.7 | | 1.7 | | 1.7 |
| 18. | 2.4 | | 2.0 | | 1.9 | | 1.7 | | 1.8 | | 1.8 |
| 19. | 2.5 | | 2.0 | | 1.9 | | 1.6 | | 1.7 | | 1.7 |
| 20. | 2.8 | 50. | 2.2 | 80. | 1.9 | 110. | 1.6 | 140. | 1.7 | 170. | 1.7 |
| 21. | 2.5 | | 2.1 | | 2.0 | | 1.6 | | 1.7 | | 1.7 |
| 22. | 2.8 | | 1.9 | | 2.0 | | 1.6 | | 1.7 | | 1.7 |
| 23. | 2.7 | | 1.9 | | 2.0 | | 1.6 | | 1.7 | | 1.8 |
| 24. | 2.7 | | 1.8 | | 2.0 | | 1.7 | | 1.7 | | 1.8 |
| 25. | 2.8 | | 1.7 | | 2.1 | | 1.6 | | 1.8 | | 1.7 |
| 26. | 2.8 | | 1.7 | | 1.9 | | 1.6 | | 1.7 | | 1.8 |
| 27. | 2.9 | | 1.7 | | 1.8 | | 1.6 | | 1.7 | | 1.8 |
| 28. | 2.9 | | 1.7 | | 1.7 | | 1.7 | | 1.7 | | 1.8 |
| 29. | 2.6 | | 1.7 | | 1.7 | | 1.7 | | 1.7 | | 1.7 |
| 30. | 2.5 | 60. | 1.8 | 90. | 1.7 | 120. | 1.7 | 150. | 1.6 | 180. | 1.7 |

Supply Water at 17.5° C.
1 × 10 oz. Glass samples every 20 seconds for 1 hour.
Total 180 Glasses (1800 fluid ounces) = 11.25 Gallons = 51.2 liters As the beverage passes through the chiller in each canister, it is passed through four single pipes concurrently and then returns to a separate set of four pipes that are all identical in size. Consequently, the beverage is passed through eight sets of four pipes in each canister. This lengthy and convoluted route for the beverage to pass is contained within the source of refrigerant which means that there is an enormous opportunity for heat exchange between the refrigerant and the beverage. Consequently, the beverage chiller has the capacity to chill beverages to the desired temperatures of 2 to 3° C. whilst providing a flow rate of 50 litres an hour. The design of the beverage chiller provides a heat exchanger of high efficiency which allows the performance criteria to be reached with a very compact unit that is very efficient in the use of power.

This system is designed to operate on a variety of refrigerants and especially 134A or R12.

Each canister is mounted with its axis vertical and filled to 75% of full capacity with refrigerant. The T.X. valve controls throughput of refrigerant whilst at the same time acting as a level control. A T.X. valve is a simpler and more efficient means of controlling refrigerant levels than the complicated float valve that is currently used. The beverage

What is claimed is:

1. A beverage chiller comprising at least two interconnected canisters, each canister defining a chamber for refrigerant, said chamber including a plurality of pipes extending along the length of the chamber for the flow of beverage therethrough, each canister including a flow control means to ensure flow of beverage up and down the refrigerant chamber in a plurality of cooling passes, wherein said at least two canisters are interconnected such that the beverage completes its cooling passes in one canister before completing farther cooling passes in the second canister, said refrigerant chambers being pressure balanced and arranged to be coupled to a source of refrigeration via a thermostatic expansion valve.

2. The beverage chiller according to claim 1 wherein said flow control means is provided at each end of each canister to ensure flow of beverage up and down the refrigerant chamber in a plurality of cooling passes.

3. The beverage chiller according to claim 2 wherein said flow control means comprises a partitioned plate provided at each end of each canister.

4. The beverage chiller according to claim 1 wherein each of said chambers is coupled to a source of refrigerant and an evaporator pressure regulator valve.

5. The beverage chiller according to claim 1 wherein said refrigerant chambers of said canisters are interconnected at three points along the length of the canister where a first connection is a suction connection that is in turn coupled to a compressor of a refrigeration circuit, a second connection is a balancing pipe that ensures pressure balance between said canisters, and a third connection is a thermal expansion valve feed connection.

6. The beverage chiller according to claim 1 wherein each canister is mounted such that its principal axis lies in a vertical plane.

7. The beverage chiller according to claim 1 wherein said plurality of pipes of each chamber are arranged in an array which is parallel to the principal axis of the canister.

8. A beverage chiller comprising at least two interconnected canister, each canister defining a chamber for refrigerant, said chamber including a plurality of pipes extending along the length of the chamber for the flow of beverage therethrough, each canister including a flow control means to ensure flow of beverage up and down the refrigerant chamber in a plurality of cooling passes, said refrigerant chambers being pressure balanced and arranged to be coupled to a source of refrigeration via a thermostatic expansion valve, wherein said refrigerant chambers of said canisters are interconnected at three points along the length of the canister where a first connection is a suction connection that is in turn coupled to a compressor of a refrigeration circuit, a second connection is a balancing pipe that ensures pressure balance between said canisters, and a third connection is a thermal expansion valve feed connection.

9. The beverage chiller according to claim 8, wherein said at least two canisters are interconnected such that the beverage completes its cooling passes in one canister before completing further cooling passes in the second canister.

10. The beverage chiller according to claim 8 wherein said flow control means is provided at each end of each canister to ensure flow of beverage up and down the refrigerant chamber in a plurality of cooling passes.

11. The beverage chiller according to claim 10 wherein said flow control means comprises a partitioned plate provided at each end of each canister.

12. The beverage chiller according to claim 8 wherein each of said chambers is coupled to a source of refrigerant and an evaporator pressure regulator valve.

13. The beverage chiller according to claim 8 wherein each canister is mounted such that its principal axis lies in a vertical plane.

14. The beverage chiller according to claim 8 wherein said plurality of pipes of each chamber are arranged in an array which is parallel to the principal axis of the canister.

* * * * *

UNITED STATES PATENT AND TRADEMARK OFFICE

CERTIFICATE OF CORRECTION

PATENT NO : 6,116,041

DATED : September 12, 2000

INVENTOR(S) : Cassell

It is certified that error appears in the above-identified patent and that said Letters Patent is hereby corrected as shown below:

In the Abstract

Delete the word "thereghrough" and replace with the word -- therethrough --.

In the Specification

Column 5, line 14, delete the first instance of the word "canister" and replace it with -- canisters --.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*